United States Patent [19]

Delpercio et al.

[11] Patent Number: 4,620,684

[45] Date of Patent: Nov. 4, 1986

[54] SUPPORT BRACKET ASSEMBLY

[75] Inventors: Michael J. Delpercio, Fenton; Charlie R. Holland, St. Louis, both of Mo.

[73] Assignee: Coin Acceptors, Inc., St. Louis, Mo.

[21] Appl. No.: 687,521

[22] Filed: Dec. 28, 1984

[51] Int. Cl.[4] ..... E04G 5/06

[52] U.S. Cl. ..... 248/225.2; 312/245; 312/263

[58] Field of Search ..... 248/225.2, 220.2, 222.3, 248/222.4, 223.1, 223.2, 223.4, 224.3, 225.1; 312/245, 263, 253, 243

[56] References Cited

U.S. PATENT DOCUMENTS

| | | | |
|---|---|---|---|
| 1,232,961 | 7/1917 | Ohnstrand | 312/263 X |
| 2,010,246 | 8/1935 | Slawson | 248/311.2 X |
| 2,692,689 | 10/1954 | Wynne | 248/222.4 X |
| 3,260,559 | 7/1966 | Newman et al. | 312/245 X |
| 3,731,956 | 5/1973 | Hanley | 248/223.1 X |
| 3,927,315 | 12/1975 | Werry | 248/223.4 X |
| 4,264,113 | 4/1981 | Suttles | 312/263 X |
| 4,314,685 | 2/1982 | Schwan | 248/223.4 X |

FOREIGN PATENT DOCUMENTS

| | | | |
|---|---|---|---|
| 197541 | 5/1938 | Switzerland | 312/245 |

*Primary Examiner*—J. Franklin Foss

*Attorney, Agent, or Firm*—Cohn, Powell & Hind

[57] ABSTRACT

This support bracket and cabinet assembly includes a bracket having a wall-attached single bar member provided with vertically spaced outstanding lug members and a cabinet having a rear wall provided with corresponding vertically spaced openings receiving the lug members. The cabinet rear wall includes a channel-shaped recess receiving the bar member and having a second set of openings receiving the heads of the fasteners attaching the bracket to the wall. Each lug member includes an inclined portion providing a bearing for an upper support margin of the lug receiving openings tending to draw the cabinet into engagement with the wall.

9 Claims, 3 Drawing Figures

SUPPORT BRACKET ASSEMBLY

BACKGROUND OF THE INVENTION

This invention relates generally to support brackets for mounting articles to a wall and particularly to a bracket for closely mounting a cabinet to a wall.

One of the conventional methods of mounting relatively heavy cabinets to a wall requires that the cabinet be provided with openings in the back wall of the cabinet which receive wall mounting fasteners. While this is a simple procedure there are several problems. For example, it is often difficult to attach the fasteners to wall studs because of the lack of alignment between the wall studs and the cabinet opening. To counter this, various elaborate types of bolts have been developed which are intended to attach directly to the wall board rather than to the studs. However, this procedure is often ineffective with heavy cabinets. Another conventional method of mounting cabinets to a wall is to provide a shelf which is itself supported by a pair of ell-shaped brackets. While this method provides greater versatility with respect to the location of the studs it presents an unsightly appearance.

The present bracket solves the above and other problems in a manner not revealed by the known prior art.

SUMMARY OF THE INVENTION

This support bracket assembly provides for the mounting of a cabinet to a wall by using a single bar member which can readily be attached to the wall at the vertical stud location utilizing conventional fasteners of the simplest kind.

It is an aspect of this invention to provide a cabinet including a rear wall having a plurality of vertically spaced openings each opening having an upper support portion and a single, wall-attachable bracket having a plurality of fastener-receiving means, said bracket including an elongate bar member having a front face and a plurality of outstanding vertically spaced lug members attached to the bar member, each lug member being receivable into an associated cabinet wall opening, at least one of the lug members having a bearing portion receiving a support portion of one of the cabinet openings in bearing relation to transfer the weight of the cabinet to the wall so that once the bracket is mounted to the wall no other fasteners are necessary and the bracket, though firmly supported, can be readily removed and replaced if desired.

In another aspect of this invention the cabinet rear wall includes a recessed channel receiving the bar member and the vertically spaced openings are located in said channel so that the cabinet can be closely mounted to the wall.

In still another aspect of this invention the fasteners mounting the bracket to the wall include outstanding heads and the cabinet rear wall includes a plurality of verticaly spaced openings each receiving a fastener head to facilitate utilization of conventional fasteners while maintaining the cabinet in close engagement with the wall.

It is still another aspect of this invention to provide that the lug members include an inclined bearing portion engageable by a support margin of a corresponding cabinet rear wall opening so that the cabinet is supported at several vertical points without the need for extreme accuracy and, in addition, the cabinet tends to be drawn into engagement with the wall.

In still another aspect of the invention the lug members are punched out and integrally formed with the bar member and the recessed channel in the cabinet rear wall is of substantially the same depth as the thickness of the bar member to provide that the rear of the cabinet is substantially flush with the wall.

DESCRIPTION OF THE PREFERRED EMBODIMENT

Figure 1:
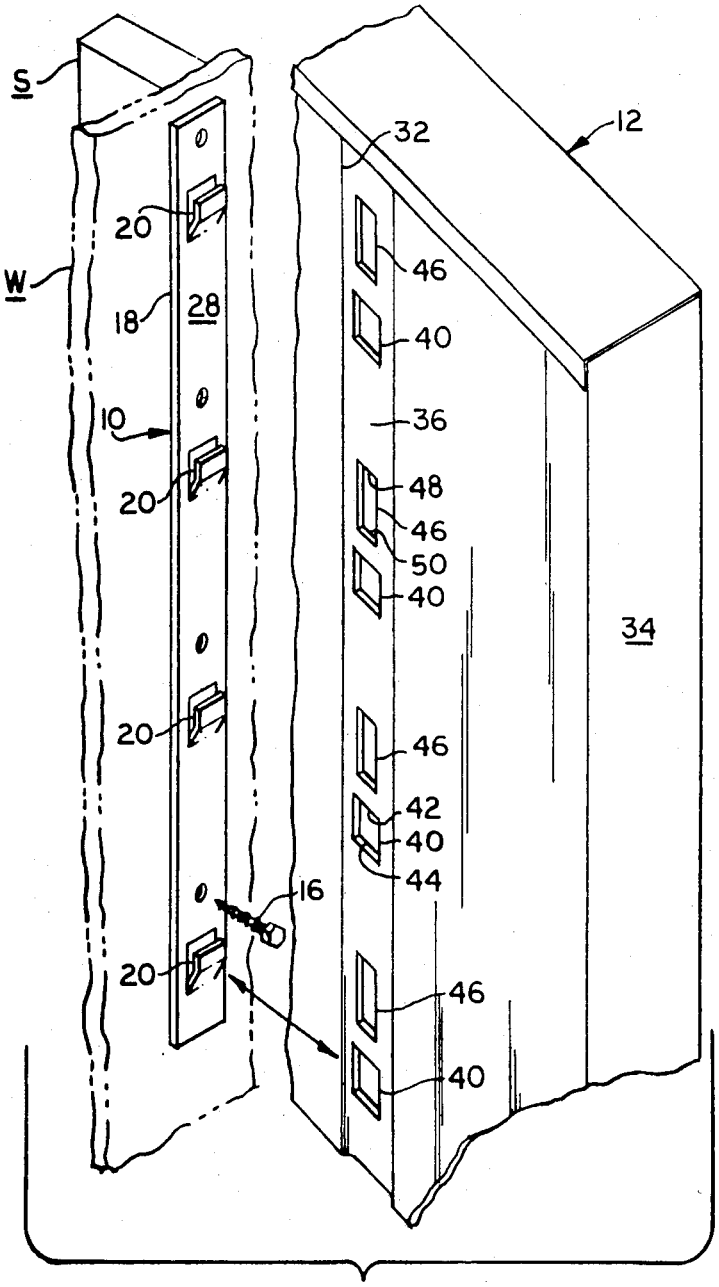
FIG. 1 is a perspective view of the bracket and cabinet prior to assembly.

Referring now by reference numberals to the drawings and first to FIG. 1 it will be understood that a single wall-attachable bracket 10 is provided for mounting a cabinet 12 to a wall W.

The bracket 10 includes a plurality of openings 14, four in number in the embodiment shown, for receiving fasteners such as lag bolts 16. Preferably, the bracket 10 is vertically aligned with wall stud S to provide secure support.

Figure 2:
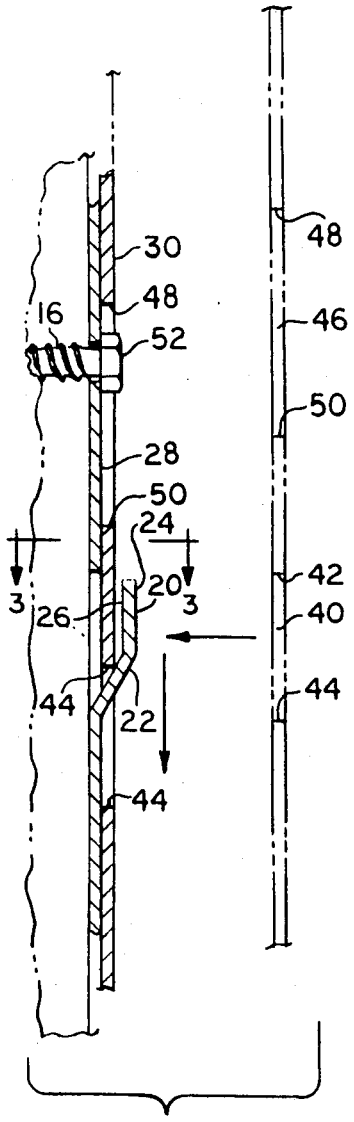
FIG. 2 is a fragmentary vertical cross-sectional view taken through the bracket and the cabinet following assembly and also illustrating the cabinet in phantom outline prior to assembly.
Figure 3:
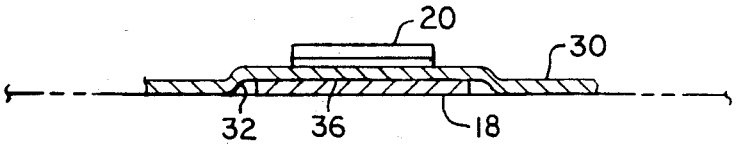
FIG. 3 is a cross-sectional view taken on line 3—3 of FIG. 1.

The bracket 10 comprises essentially an elongate bar member 18 having a plurality of lug members 20. In the embodiment shown the lug members are punched out of the bar member 18 and are therefore integrally formed with said member. As best shown in FIG. 2 each of the lug members 20 is unitarily formed with the bar member and includes an inclined portion 22 and an upright portion 24 providing a rear face 26 spaced from and substantially parallel with the front face 28 of the bar member 18 to receive the rear wall of the cabinet 12 as will now be described.

The cabinet 12, which can be a heavy unit such as a beverage cooler, includes a generally symmetrical rear wall 30 having a single vertical recessed channel 32 formed therewithin. In the embodiment shown the channel 32 is disposed equidistant between the cabinet endwalls 34 and is slightly greater in width than the bar member 18. The depth of the channel 32 is substantially the same as the thickness of the bar member 18. The channel rear wall portion 36 includes a plurality of lug-receiving openings 40, four in number in the embodiment shown, spaced at intervals corresponding to the spacing of the lug members 20 and having upper and lower margins 42 and 44 respectively. The channel rear wall portion 36 also includes a plurality of relatively narrow fastener head-receiving openings 46, four in number in the embodiment shown, spaced at intervals corresponding to the spacing of the fastener openings 40 and having upper and lower margins 48 and 50 respectively.

The mounting procedure is as follows. A wall stud S is located and the bracket 10 is secured to said wall stud at the appropriate height. The rear wall of the cabinet 10 is then positioned as shown in phantom outline in FIG. 2 so that the openings 40 are aligned to receive the lug members 20 which are relatively short in height, it being understood that the openings 40 are of sufficient height and width to receive the lug members 20. In this position of the cabinet 10, because of the spacing of the fastener-receiving openings 46 and the height of said openings, aligned to receive a bolt head 52. When the cabinet 12 is moved horizontally into position against the wall W and lowered the upper margin 42 of each opening 40 engages the inclined bearing portion 22 of the corresponding lug member 20. Because of the inclined nature of the bearing portion, absolute accuracy between the lug spacing and the spacing of the support margins 42 is not necessary to provide a secure attachment of the cabinet 12 to the bracket 10, each of the lug members 20 is engaged by a corresponding margin 42 providing a support portion of the cabinet 12. Further, the inclined bearing portion provides, in effect, a wedging action which draws the cabinet 12 into close contact with the wall W.

We claim as our invention:

1. A support bracket and cabinet assembly comprising:

(a) cabinet including a rear wall having a plurality of vertically spaced openings in a single sole, substantially central row, each opening having an upper support portion, (b) a single, sole wall-attachable bracket having a plurality of fastener-receiving openings, said sole bracket including an elongate bar member having a front face, and a plurality of outstanding vertically spaced lug members attached to the bar member and each lug member being operatively removably receivable into an associated cabinet wall opening, at least one of lug members having a bearing portion receiving a support portion of one of said cabinet openings in bearing relation, and (c) a plurality of fasteners received by the bracket openings.

2. An assembly as defined in claim 1, in which:

(d) the cabinet rear wall includes a recessed channel receiving the bar member and the vertically spaced openings are located in said channel.

3. An assembly as defined in claim 1, in which:

(d) the fasteners includes heads, and (e) the cabinet rear wall includes a plurality of vertically spaced openings each receiving a fastener head.

4. An assembly as defined in claim 1, in which:

(d) each of said lug members includes an inclined portion providing a bearing portion receiving a support portion of said cabinet openings.

5. An assembly as defined in claim 1, in which:

(d) said lug members are integrally formed from said bracket member and each includes an inclined portion providing a bearing portion receiving a support portion of said cabinet openings.

6. An assembly as defined in claim 1, in which:

(d) the rear cabinet wall includes a recessed channel having a depth substantially equal to the thickness of the bar member, (e) the vertically spaced openings are located in said channel, and (f) the lug members are integrally formed from said bracket member and each includes an inclined portion receiving a support portion of said cabinet openings.

7. An assembly as defined in claim 6, in which:

(g) each lug member includes an upper upright portion integrally formed with said inclined portion and having a rear face substantially parallel with the front face of the bar member.

8. An assembly as defined in claim 1, in which:

(d) the cabinet rear wall includes a recessed channel receiving the bar member and the vertically spaced openings are located in said channel, (e) each fastener includes a head, and (f) the cabinet rear wall includes a plurality of vertically spaced openings each receiving a fastener head and said vertically spaced openings are located in said channel.

9. An assembly as defined in claim 8, in which:

(g) the lug members are formed from the bracket and are of a height shorter than the openings into which they are received, and (h) the fastener head receiving openings include an upper margin and a lower margin spaced apart a distance greater than the height of the lug members.

* * * * *